US007926430B2

(12) United States Patent
Bakker et al.

(10) Patent No.: US 7,926,430 B2
(45) Date of Patent: Apr. 19, 2011

(54) TECHNOLOGY TROUGH

(75) Inventors: Mitchell R. Bakker, Holland, MI (US); Christopher M. Phillips, Avon, NY (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 11/966,299

(22) Filed: Dec. 28, 2007

(65) Prior Publication Data

US 2009/0165680 A1 Jul. 2, 2009

(51) Int. Cl.
*A47B 37/00* (2006.01)

(52) U.S. Cl. ..... 108/50.02; 108/25

(58) Field of Classification Search ..... 108/50.01, 108/50.02, 25; 312/194, 195, 223.3, 223.6
See application file for complete search history.

(56) References Cited

U.S. PATENT DOCUMENTS

| | | | | |
|---|---|---|---|---|
| 4,296,981 | A | 10/1981 | Hildebrandt et al. | |
| 4,654,756 | A | 3/1987 | Wilson et al. | |
| 4,688,491 | A | 8/1987 | Herrera et al. | |
| 4,730,363 | A | 3/1988 | Asbaghi | |
| 5,230,552 | A | 7/1993 | Schipper et al. | |
| 5,231,562 | A * | 7/1993 | Pierce et al. | 361/832 |
| 5,415,010 | A * | 5/1995 | Woo | 62/258 |
| 5,451,101 | A * | 9/1995 | Ellison et al. | 312/223.6 |
| 5,709,156 | A | 1/1998 | Gevaert et al. | |
| 5,967,820 | A * | 10/1999 | Siegal et al. | 439/214 |
| 6,162,071 | A * | 12/2000 | Muller | 439/142 |
| 6,216,606 | B1 * | 4/2001 | Kathardekar et al. | 108/50.02 |
| 6,338,301 | B1 * | 1/2002 | Almond | 108/50.02 |
| 6,629,505 | B1 | 10/2003 | Cronk et al. | |
| 6,647,900 | B1 | 11/2003 | Kopish | |
| 6,725,784 | B2 * | 4/2004 | Crinion | 108/64 |
| 6,732,661 | B2 | 5/2004 | Grasse et al. | |
| 6,895,868 | B1 * | 5/2005 | Cronk et al. | 108/50.02 |
| 2005/0268823 | A1 * | 12/2005 | Bakker et al. | 108/50.02 |
| 2006/0042520 | A1 * | 3/2006 | Stevens et al. | 108/50.02 |
| 2006/0096506 | A1 * | 5/2006 | Brauning et al. | 108/50.02 |

OTHER PUBLICATIONS

Product Brochure, Gunlocke Converge, Sep. 2007, 25 pp.
Price & Specification Guide, Gunlocke Converge, Apr. 2007, 128 pp.

* cited by examiner

*Primary Examiner* — Janet M Wilkens
*Assistant Examiner* — Dan Rohrhoff
(74) *Attorney, Agent, or Firm* — Faegre & Benson LLP

(57) ABSTRACT

A conference table includes a technology trough assembly integrated into its worksurface. The technology trough includes one or more utility modules for providing customized utility connections to meet the users' requirements. The technology trough also includes sliding access panels that are flush with the worksurface of the table and that are adapted to slide along a horizontal plane between a closed and an open position over the utility modules such that do not interfere or obstruct visual or verbal communications between users.

21 Claims, 17 Drawing Sheets

TECHNOLOGY TROUGH

TECHNICAL FIELD

The present invention relates to conference tables. More particularly, the present invention relates to conference tables adapted to support conferencing equipment such as electronic, video, audio, and networking utilities.

BACKGROUND

Meetings, conferences, and seminars are making greater use of electronic and communicative devices. The devices may include such things as wiring for supporting portable computers, video sending and/or receiving/display devices, audio sending and/or receiving devices, devices permitting networking and/or that support other intercommunication activities, combinations thereof, and the like. The furniture used during meetings, conferences, and seminars should be adapted to handle the increased density and capabilities of such devices in a user-friendly way. The furniture should provide easy access to power and telecommunication lines as well as facilitate the attachment of personal computers and electronic devices to the lines and utilities provided without interfering with the verbal or visual contact between any one user.

SUMMARY

According to various embodiments of the present invention, a furniture assembly includes a planar worksurface supported on a base and at least one technology trough assembly accessible through the planar worksurface. The technology trough assembly can include a plurality of utility connections and a plurality of sliding access panels adapted to slide in a lateral direction from at least a first position wherein the utility connections are concealed to a second position, wherein the utility connections are at least partially exposed. According to some embodiments, the furniture assembly is a conference table.

According to various embodiments, the present invention is a conference table including a planar worksurface supported on base and at least one technology trough assembly integrated into the planar worksurface. The technology trough assembly is integrated into the planar worksurface such that it does not substantially protrude above a top surface of the planar worksurface. According to some embodiments, the technology trough assembly comprising a plurality of utility connections and a plurality of sliding access panels adapted to slide between a closed position in which the utility connections are concealed and an open position in which the utility connections are at least partially exposed. The sliding access panels do not substantially protrude above the top surface of the worksurface.

According to various embodiments, the present invention is a technology trough assembly including a trough portion, a bezel portion coupled to the trough portion, and a plurality of sliding access panels disposed in a space defined between the trough portion and the bezel portion. In some embodiments, the trough portion includes a top plate having a lower surface, an upper surface and a plurality of openings. A plurality of utility modules including a generally U-shaped portion defining a recess and two side walls are coupled to the lower surface of the top plate such that the recesses generally correspond to the openings in the top plate. According to some embodiments, a bezel portion is coupled to the top plate of the trough portion such that a space is defined between a lower surface of the bezel portion and an upper surface of the top plate. The plurality of sliding access panels are disposed in the space defined between the lower surface of the bezel portion and the upper surface of the top plate of the trough portion. In some embodiments, the sliding access panels have dimensions generally corresponding to dimensions of the openings in the top plate of the trough portion such that the recesses defined by the U-shaped portion of the utility modules are concealed when the sliding access panels are in a closed position. According to various embodiments, the sliding access panels are adapted to freely slide along a horizontal plane from at least a first position wherein the recesses defined by the generally U-shaped portion coupled to the top plate are concealed to a second position, wherein the recesses defined by the generally U-shaped portion are exposed. The sliding access panels do not extend upward from the horizontal plane in which they slide.

According to various embodiments, the present invention is a method of assembling an article of furniture. The method includes securing a frame to a base. Next, a trough portion including a plurality of utility modules having at least one set of blank cut-outs including at least one cut-out adapted to receive a utility connection is secured to the frame. The blank cut-outs can be customized with any number and variety of utility connections, and any additional wiring is provided. This is followed by installation of a worksurface including an opening having dimensions generally corresponding to the dimensions of the rough portion secured to the frame. The trough portion is accessible through the opening in the worksurface.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
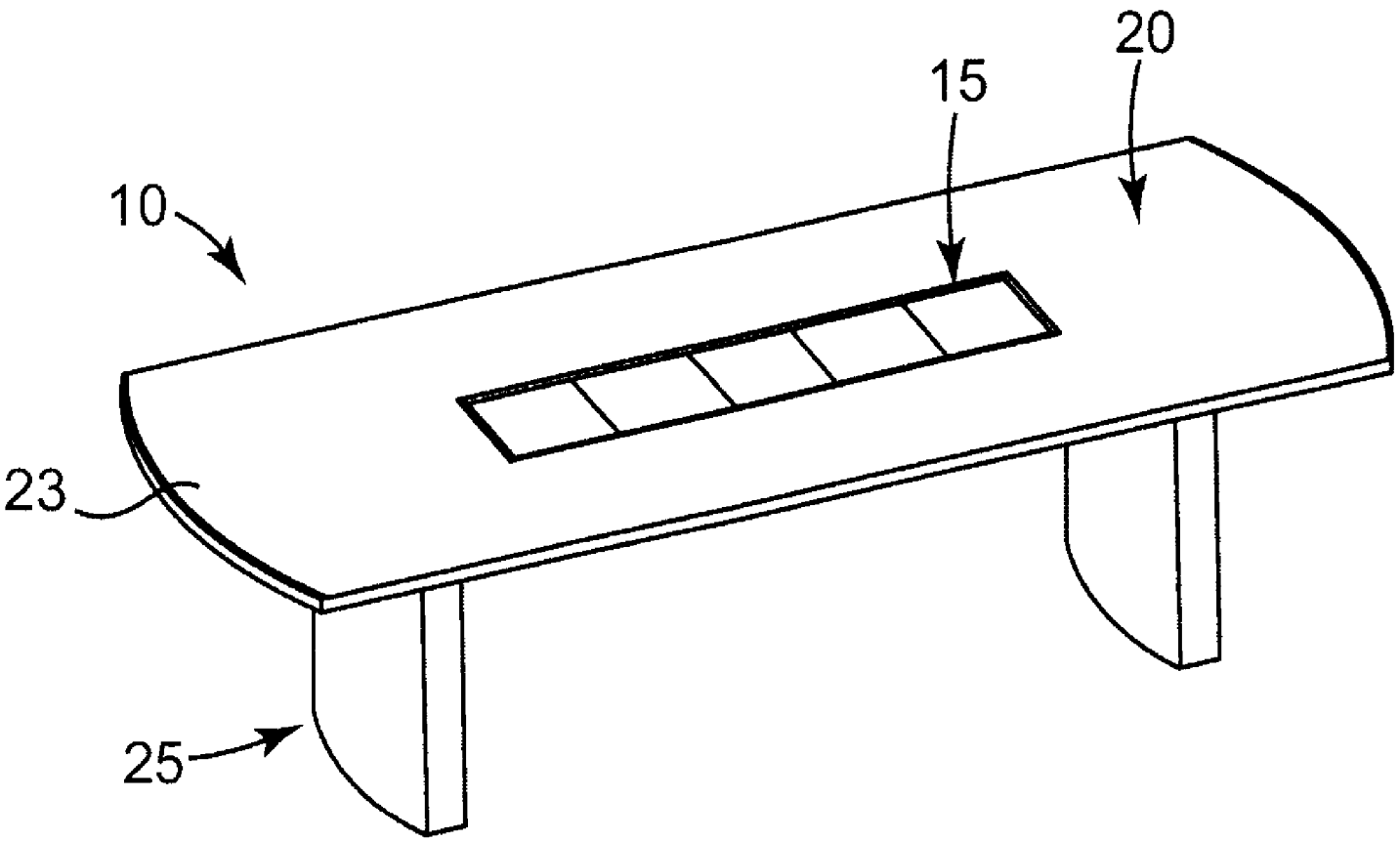
FIGS. 1A and 1B are perspective views of a conference table provided in accordance with some embodiments of the present invention.
Figure 1B:
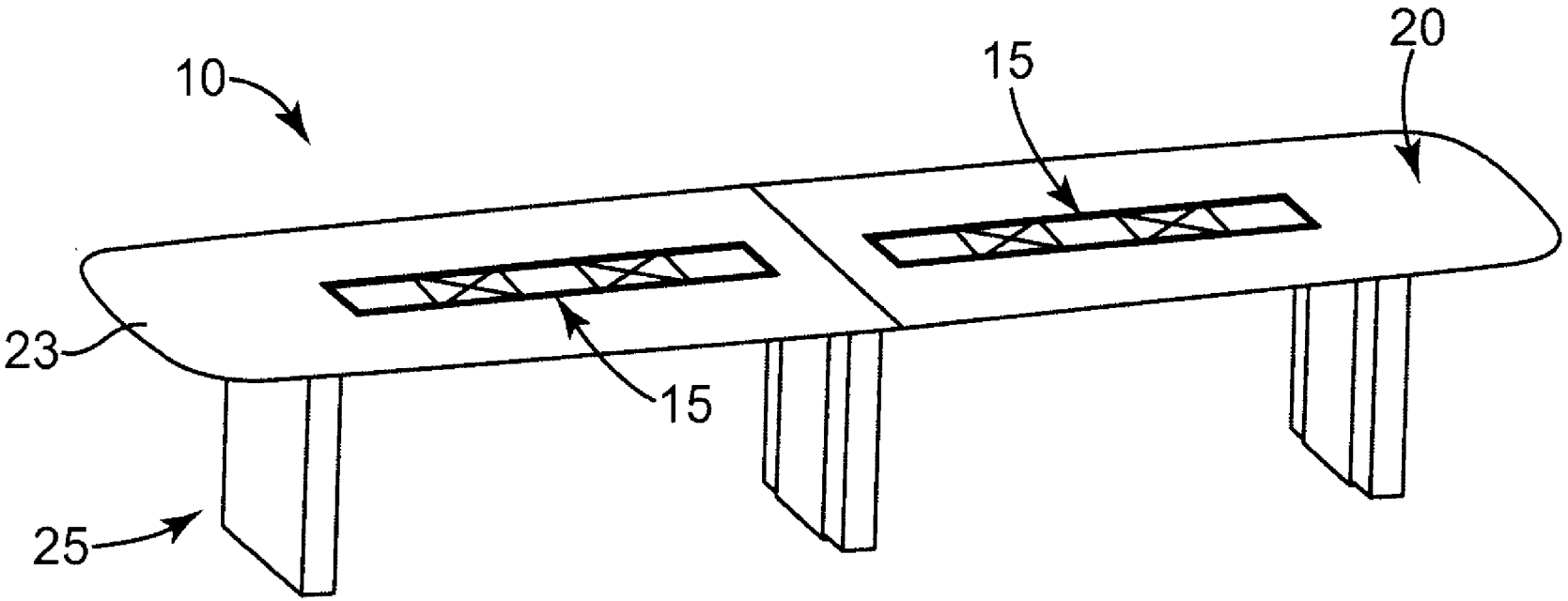

FIGS. 1A and 1B are perspective views of a conference table 10 including at least one technology trough assembly 15 according to various embodiments of the present invention. The technology trough assembly 15 is integrated into the worksurface 20 of the table 10 such that it does not substantially protrude above a top surface 23 of the worksurface 20. According to another embodiment, the technology trough assembly is integrated into the worksurface 20 such that it is substantially flush with the top surface 23 of the worksurface 20.

According to various embodiments, as shown in FIGS. 1A and 1B, the table 10 includes a base 25 supporting the worksurface 20. The worksurface 20 is coupled to and supported on the base 25. The worksurface 20 is planar and can have a variety of sizes and shapes. For example, the worksurface 20 can be round, oval, quadrangle, trapezoidal, and the like. The worksurface 20 should be sized and shaped such that it is adequately supported by the base 25. According to further embodiments of the present invention, as shown in FIG. 1B a conference table 10 or other article of furniture may include two or more technology trough assemblies 15 as determined by the users' needs.

Figure 2:
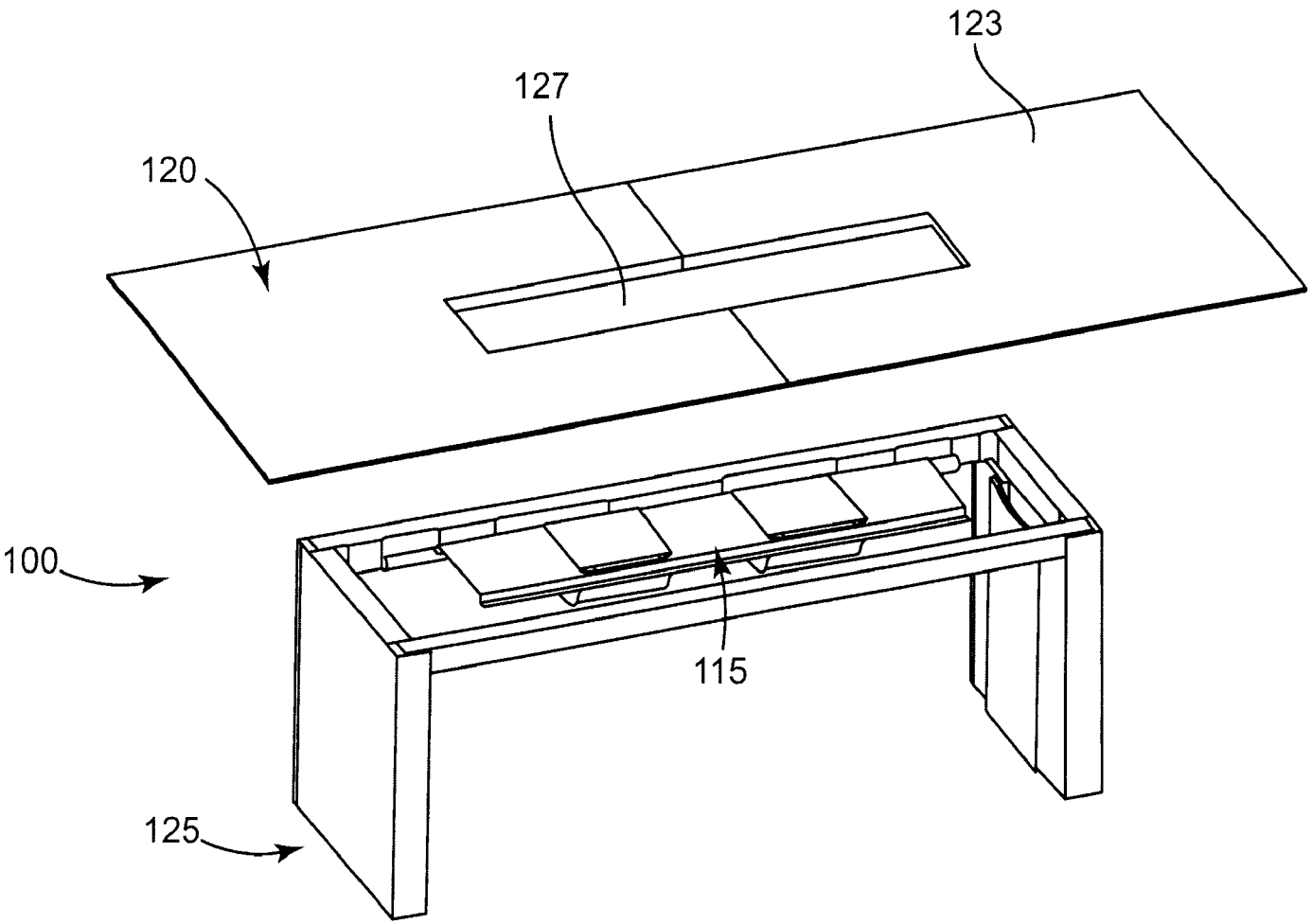
FIG. 2 is an partially exploded view of a conference table provided in accordance with an embodiment of the present invention.

FIG. 2 is a partially exploded view of the table 100 including a technology trough 115 and a worksurface 120. As shown in FIG. 2, the worksurface 120 includes one or more openings 127 having outer dimensions generally corresponding to the outer dimensions of the one or more technology troughs 115. The worksurface 120 is secured to the base 125 such that the technology trough 115 is accessible through the opening 127 in the worksurface 120.

Figure 3A:
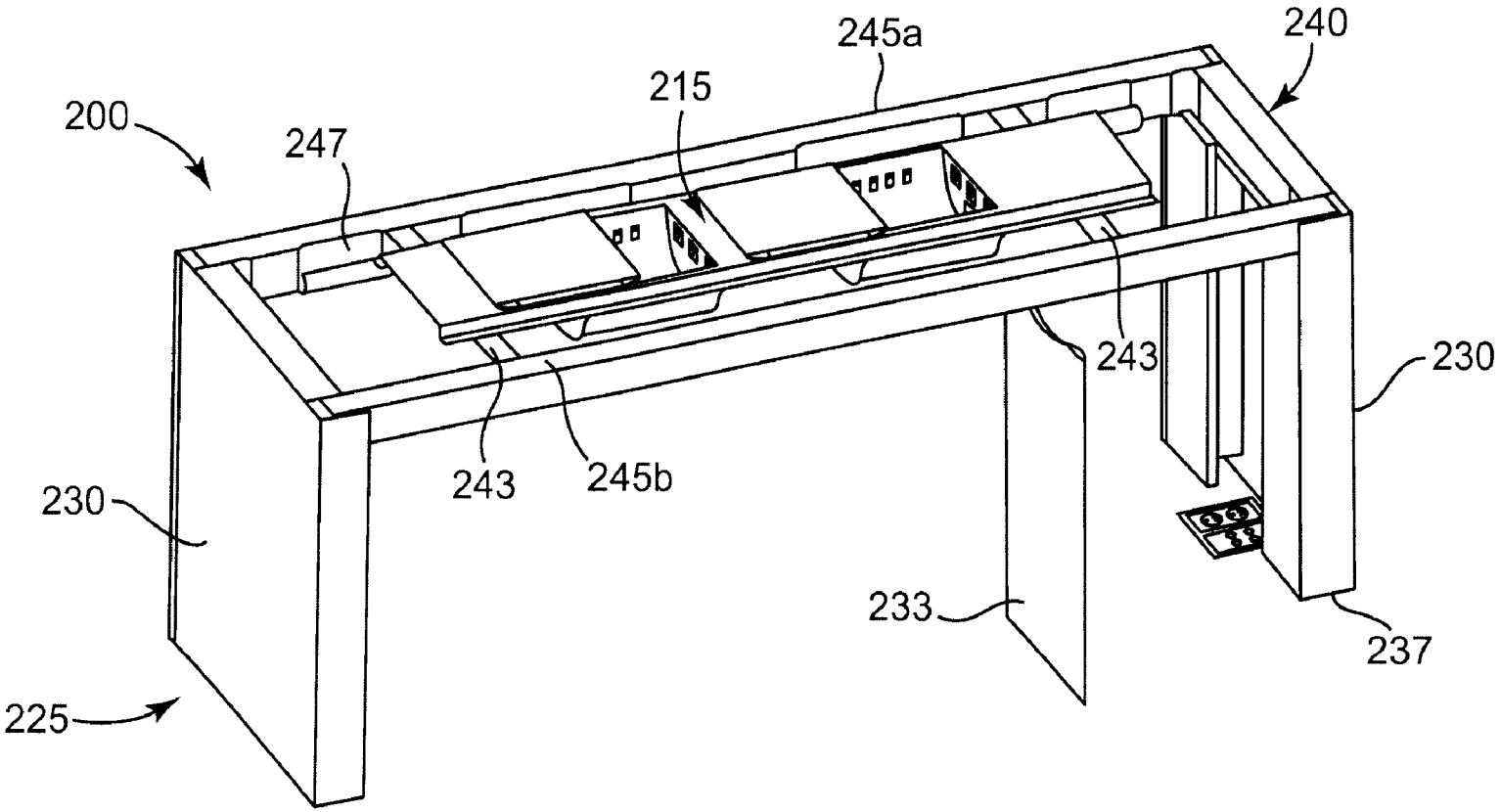
FIGS. 3A and 3B are perspective views of a conference table having its worksurface removed for ease of understanding provided in accordance with some embodiments of the present invention.

FIG. 3A is a perspective view of a table 200 having its worksurface removed, such that the technology trough assembly 215 is exposed for easy viewing. According to various embodiments, the base 225 includes at least one support member 230. The support member(s) 230 can have a variety of configurations including, but not limited to, the following: panels, legs, and pillars of varying cross-sections. According to various embodiments, at least one support member 230 is adapted to conceal and manage a plurality of wires and/or cables. According to some embodiments, as shown in FIG. 3A, the base 225 includes two support members 230 having a panel configuration. At least one of the panel support members 230 can include a removable wire management access door 233 to facilitate access to any wires and/or cables concealed within the panel member 230. Additionally, the bottom surface 237 of the panel member 230 may be elevated from the floor to accommodate a power or data source and the height of the wires and/or cables concealed within the table 200.

Also visible in FIG. 3A, is frame 240 to which the technology trough assembly 215 is secured, provided in accordance with some embodiments of the present invention. According to one embodiment the technology trough 215 can be secured to one or more brackets 243 provided on the frame 240. In some embodiments, as shown in FIG. 3A, the frame 340 includes two side rails 245*a* and 245*b*. The side rails 245*a* and 245*b* are supported on the panel support members 230. The frame 240 is coupled to and further supports the worksurface. The frame 240 is typically formed from aluminum. In some embodiments, the side rails 245*a* and 245*b* include one or more wire management features 247 located at various points along one or both of the rails 245*a* and 245*b* adapted for concealing and managing a plurality of wires and/or cables. The wire management features 247 can be integral with the side rails 245*a* and 245*b*. Typically, the wire management features 247 are formed from plastic or other similar material, and have a J-shaped profile.

Figure 3B:
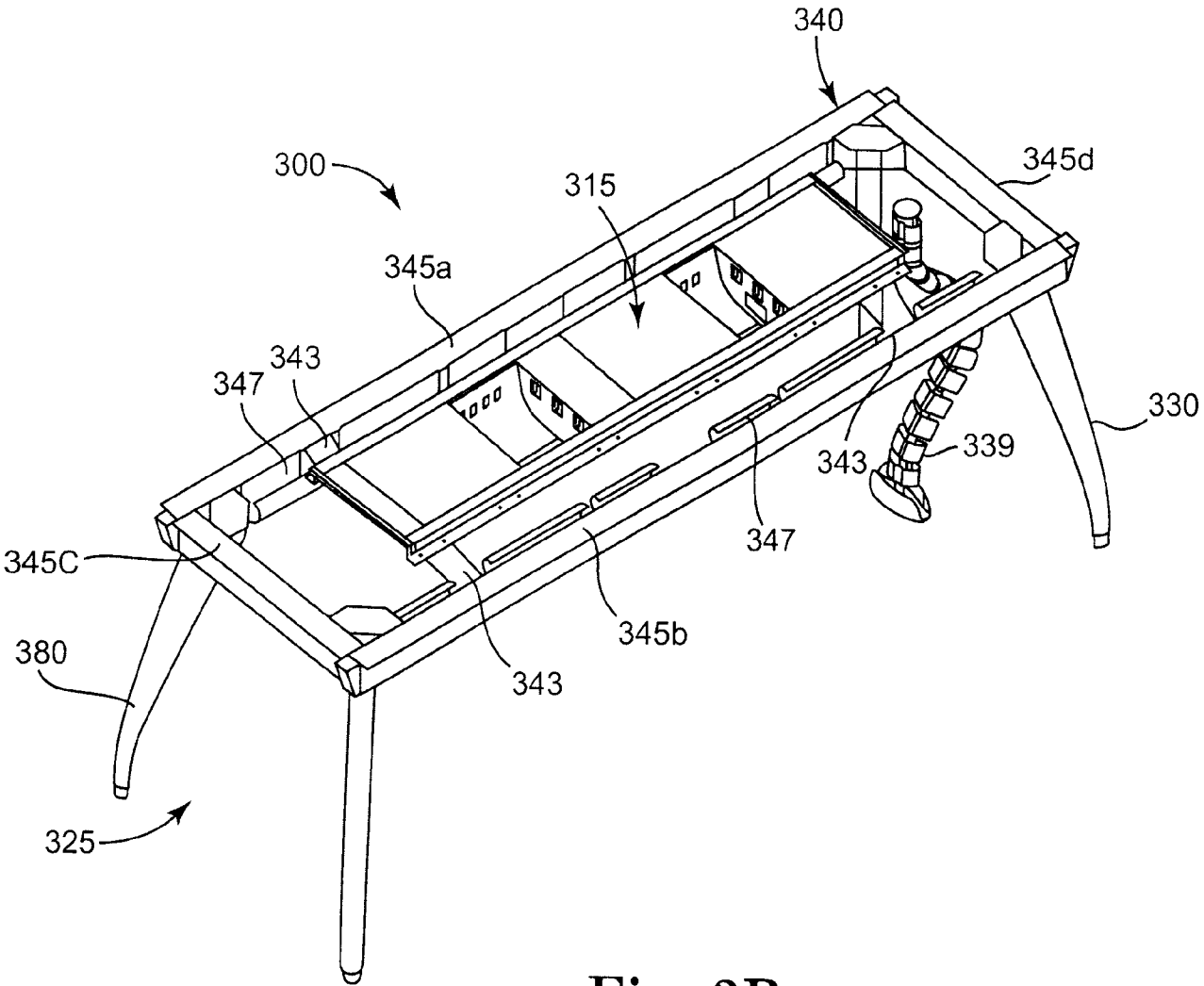

FIG. 3B is a perspective view of a table 300 according to other embodiments of the present invention. The worksurface has been removed such that the technology trough assembly 315 is exposed for easy viewing According to some embodiments, as shown in FIG. 3B, the base 325 includes four support members 330 having a leg configuration. According to this embodiment, the base 325 can also include a wire management spine 339 adapted to conceal and manage a plurality of wires and/or cables.

Also visible in FIG. 3B, is a frame 340 to which the technology trough assembly 15 is secured provided in accordance with some embodiments of the present invention. According to one embodiment the technology trough 215 or 315 can be secured to one or more brackets 343 provided on the frame 340. The frame 340 includes two side rails 345*a* and 345*b*, a front end rail 345*c*, and rear end rail 345*d*. The frame 340 is coupled to and further supports the worksurface. The frame 340 is typically formed from aluminum. The rails 345*a-d* may include one or more wire management features 347 located at various points along one or more of the rails 345*a-d* adapted for concealing and managing a plurality of wires and/or cables. The wire management features 347 can be integral with the rails 345*a-d*. Typically, the wire management features 347 are formed from plastic or other similar material, and have a J-shaped profile.

Referring to FIGS. 4A-9B, a technology trough assembly 415 adapted to be integrated into a worksurface of a furniture assembly will be described in detail below.

Figure 4A:
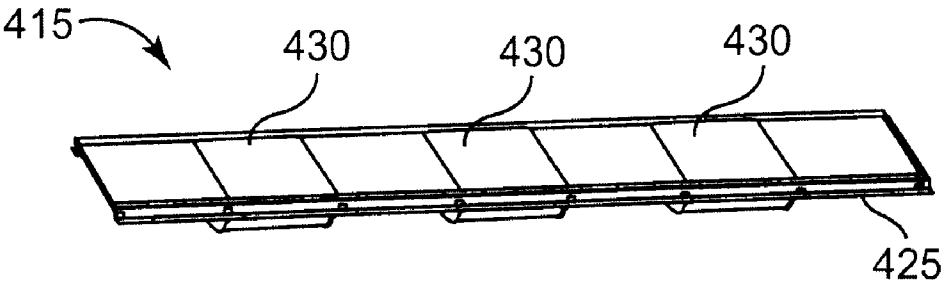
FIG. 4A is a schematic view of a technology trough assembly provided in accordance with an embodiment of the present invention.
Figure 4B:
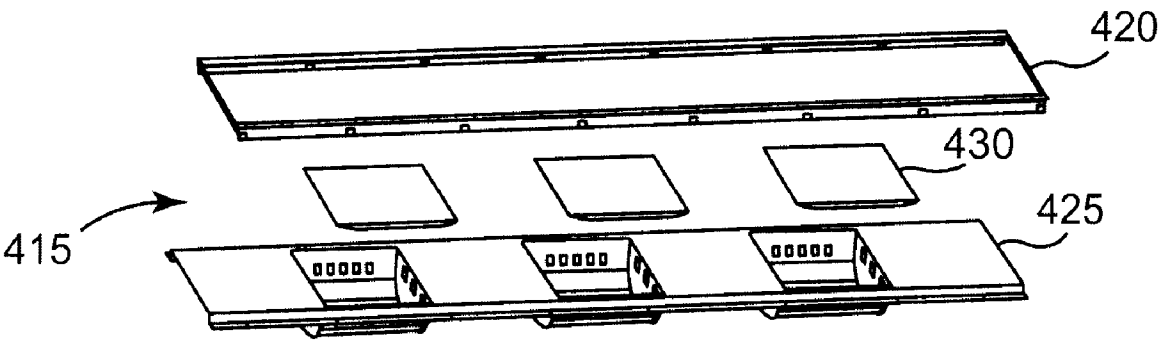
FIG. 4B is an exploded view of the technology trough assembly shown in FIG. 3A provided in accordance with an embodiment of the present invention.

FIG. 4A is a perspective view of a technology trough assembly 415 according to an embodiment of the present invention. FIG. 4B is an exploded view of the technology trough assembly 415 shown in FIG. 4A. According to various embodiments of the present invention, as best shown in FIG. 4B, the technology trough assembly 415 includes a bezel portion 420, a trough portion 425, and a plurality of sliding access panels 430. The bezel portion 420 is coupled to the trough portion 425. As will be described in further detail below, the sliding access panels 430 are disposed in a space defined between the bezel portion 420 and the trough portion 425, and are adapted to slide in a lateral direction along a horizontal plane over the trough portion 425 between a first position and a second position.

Figure 5A:
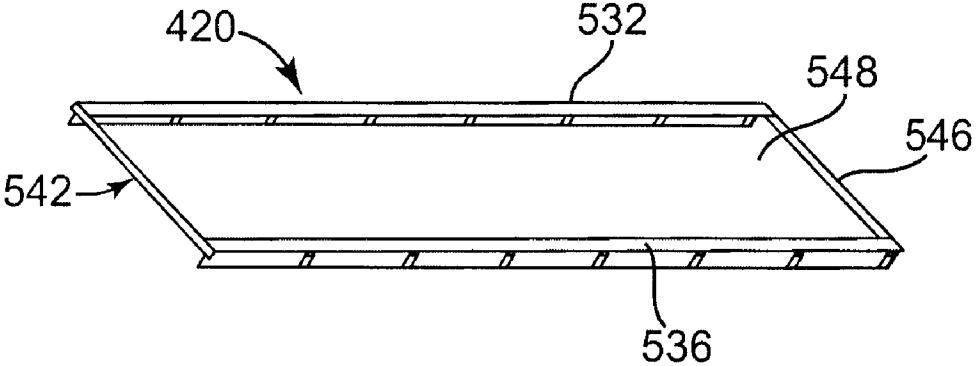
FIG. 5A is a perspective view of a bezel portion of a technology trough assembly provided in accordance with an embodiment of the present invention.

FIG. 5A is a perspective view of the bezel portion 420 according to various embodiments of the present invention. As shown in FIG. 5A, the bezel portion 420 is defined by first and second side members 532 and 536 held in a spaced apart relationship from one another by first and second end members 542 and 546. The first and second side members 532 and 536 and first and second end members 542 and 546 are secured to one another to form the bezel portion 420 using a variety of fasteners known to those of skill in the art. The bezel portion 420 defines an opening 548 through which the trough portion 425 and the sliding access panels 430 are accessible.

Figure 5B:
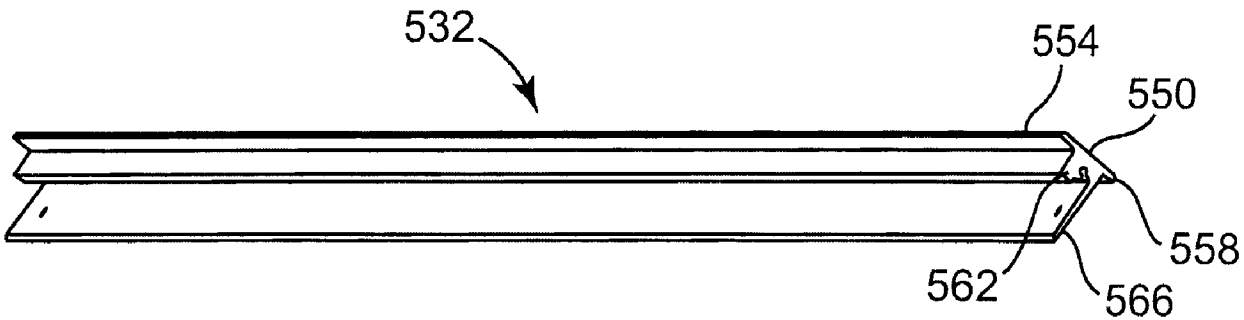
FIG. 5B is a perspective view of a side member of the bezel portion shown in FIG. 5A provided in accordance with an embodiment of the present invention.
Figure 5C:
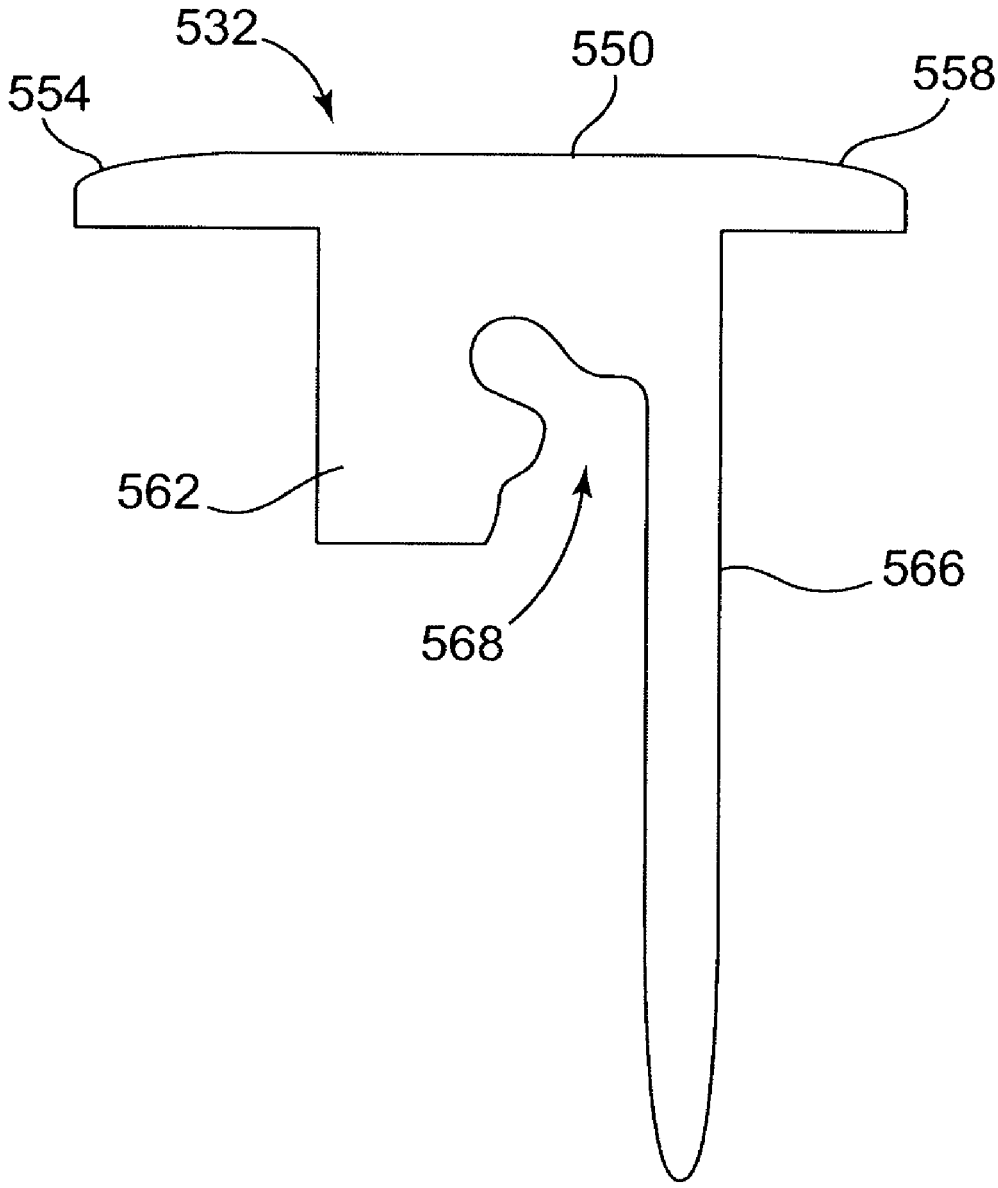
FIG. 5C is an end view the side member shown in FIG. 5B provided in accordance with an embodiment of the present invention.

FIG. 5B is a perspective view of a side member 532 used to form the bezel portion 420. FIG. 5C is an end view of side member 532 shown in FIG. 5B. It is generally understood that side member 536 is a mirror-image of side member 532. As shown in FIG. 5B, each side member 532 or 536 is an elongate extrusion formed from aluminum or another similar material. As best shown in FIG. 5C, each side member 532 and 536 includes a top portion 550 having an inner lip 554 and an outer lip 558, a contact portion 562, and an extended portion 566. A notch 568 is located in the contact portion 562 and is configured to receive a fastener for securing end members 542 and 546 to each side member in a spaced apart relationship as described above. The extension portion 566 is used to secure the side members 532 and 536 of the bezel portion 420 to the trough portion 425 described below such that a space is defined between the inner lip 554 of the side members 532, 536 and an upper surface trough portion 425.

Figure 6:
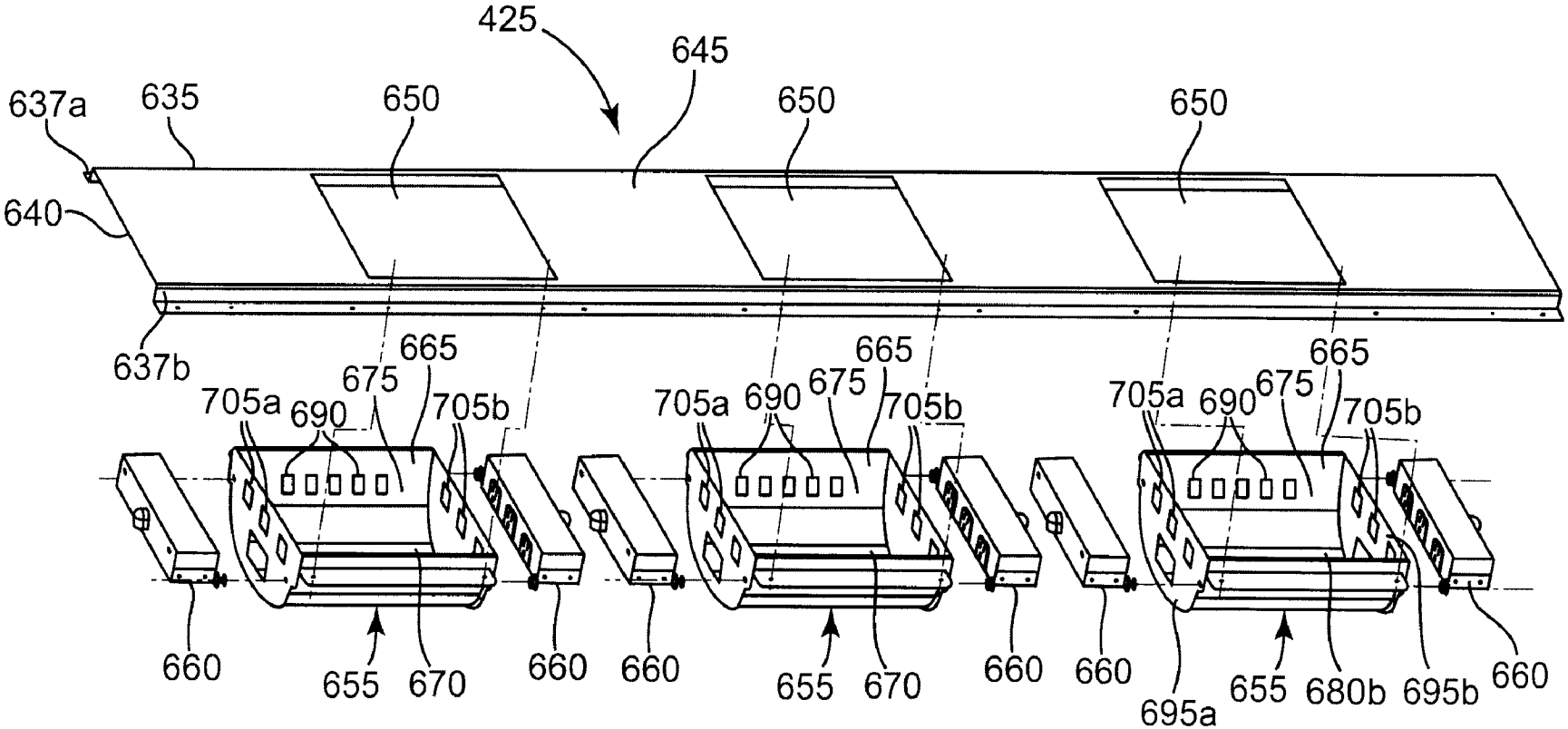
FIG. 6 is an exploded view of a trough portion of a technology trough assembly provided in accordance with an embodiment of the present invention.

FIG. 6 is an exploded view of the trough portion 425, introduced in FIGS. 4A and 4B, according to various embodiments of the present invention, to which the bezel portion 420 is coupled. As shown in FIG. 6, the trough portion 425 includes a top plate 635 including two side walls 637*a* and 637*b*. The top plate 635 also includes a lower surface 640 and an upper surface 645 and one or more openings 650 formed therein. The trough portion 425 also includes a plurality of utility modules 655 adapted to be secured to the lower surface 640 such that the utility modules 655 are accessible through the openings 650.

Figure 7:
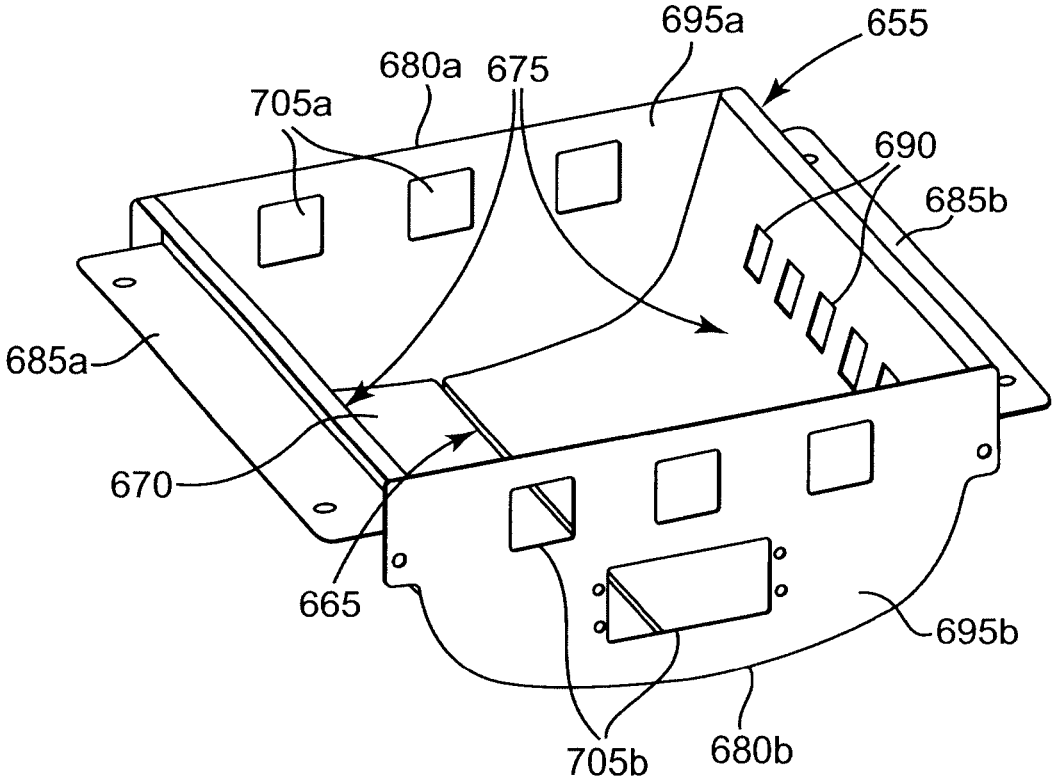
FIG. 7 is a perspective view of a utility module provided in accordance with an embodiment of the present invention.

FIG. 7 is a perspective view of a utility module 655 as shown in FIG. 6. Each utility module 655 includes a U-shaped portion 665 forming a recess 670 and having an exposed face 675 and two side walls 680*a*, 680*b*. According to various embodiments, each of the utility modules 655 can be a weldment or other similar assembly formed from one or more pieces of aluminum, steel, or other similar material. The U-shaped portion 665 includes two mounting flanges 685*a*, 685*b* adapted for securing the utility module 655 to the lower surface 640 of the top plate 635, shown in FIG. 6. Each utility module 655 is secured to the lower surface 640 of the top plate 635 such that the recesses 670 formed by each of the U-shaped portions 665 correspond to the openings 650 formed in the top plate 635. A plurality of utility and/or power boxes 660 may be coupled to each utility module.

According to various embodiments of the present invention, the recesses 670 are sized such that they are capable of storing and/or concealing conferencing equipment when such equipment is not in use. According to various embodiments, the recesses 670 are sized such that they are capable of storing and/or concealing power and data cords, small projectors (e.g. LCD, slide, etc.), speaker/conference telephones, and the like.

As shown in FIGS. 6 and 7, the U-shaped portion 665 includes an exposed face 675. According to various embodiments, each exposed face 675 includes a first set of blank cut-outs 690 including at least one blank cut-out sized and adapted to receive a variety of utility connections. According to one embodiment, the first set of cut-outs 690 includes a plurality of blank cut-outs sized and adapted to receive a variety of connections from a variety of manufactures including, but not limited to, the following: Extron, Leviton, Allen Tel, Amp, Panduit and Siemon. Exemplary utility connections include connectors for audio/visual equipment, telecommunications equipment, voice connections, data connections, power connections, control connections, and the like. More specific examples include, but are not limited to, the following: Extron architectural adapter plates (AAP), Extron double architectural adapter plates, AC power inputs, bayonet style co-axial connectors (BNC), RCA connections, RJ11 connections, RJ45 connections, S-video connections, VGA connections, and audio connections.

According to various embodiments of the present invention, individual cut-outs included within the first set of cut-outs 690 may be each sized and shaped such that they are adapted to receive different types of connections. According to one embodiment of the present invention, as shown in FIGS. 6 and 7, the first set of cut-outs 560 provided in the exposed face 575 of the U-shaped portion 665 includes a plurality of blank cut-outs sized to accommodate data and/or telecommunication connections. According to a further embodiment of the present invention, the first set of cut-outs 690 can include at least one cut-out sized and adapted to receive an AC power input connection. According to yet another further embodiment of the present invention, the first set of cut-outs can include at least one cut-out sized and adapted to receive an Extron AAP or AAP double plate.

Additionally, as shown in FIGS. 6 and 7, each utility module 655 also includes two side walls 695*a* and 695*b*. The sidewalls 695*a* and 695*b* include additional sets 705*a*, 705*b* of blank cut-outs. One or more utility or power boxes, 660, as shown in FIG. 6, can be coupled to each side wall such that the utility and/or power connections contained therein mate with the blank cut-outs provided in the side walls 695*a* and 695*b*. According to various embodiments, a second set of cut-outs 705*a* is provided in a first side-wall 695*a*. According to other various embodiments, a third set 705*b* of cut-outs can be provided in a second side-wall 695*b*. Like the first set of cut-outs 690, described above, the individual cut-outs included in the second and third sets of cut-outs 705*a* and 705*b* can be sized to receive a variety of connections from a variety of manufacturers including, but not limited to, the following: Extron, Leviton, Allen Tel, Amp, Panduit and Siemon. Exemplary utility connections include connectors for audio/visual equipment, telecommunications equipment, voice connections, data connections, power connections, control connections, and the like. More specific examples include, but are not limited to, the following: Extron architectural adapter plates (AAP), Extron double architectural adapter plates, AC power inputs, bayonet style co-axial connectors (BNC), RCA connections, RJ11 connections, RJ45 connections, S-video connections, VGA connections, and audio connections. According to various embodiments of the present invention, individual cut-outs included within the second and third set of cut-outs 605*a* and 605*b* can be each sized and shaped such that they are adapted to receive different types of connections.

According to one embodiment, as best shown in FIG. 7, the second set of cut-outs 705*a* and/or the third set of cut-outs 705*b* can be sized to receive power connections, such as those for supplying AC power. According to some embodiments, the second set of cut outs 705*a* and/or third set of cut-outs 705*b* includes cut-outs sized to receive power connections and/or data connections. According to other embodiments, the second set of cut-outs 705*a* and/or the third set of cut-outs 705*b* provided in the second side-wall includes at least one cut-out sized to receive an Extron single or double architectural adapter plate (AAP). An Extron AAP plate is provided to provide for user specified audio and visual connections. Exemplary architectural adapter plates can be purchased from Extron Electronics of Anaheim, Calif. located on the world wide web at www.extron.com. According to one embodiment of the present invention, the third set of cut-outs includes at least one cut-out sized to receive an Extron AAP Double Space Blank Plate. Additional cut-outs may be provided to accommodate additional power and/or data connections as required by the user.

The first, second and third sets of blank cut-outs 690, 705*a*, and 705*b* facilitate the customization of the technology trough assembly 425 to a user's needs. Additionally, the first, second, and third sets of cut-outs 690, 705*a*, and 705*b* facilitate reconfiguration of the data and power connections over time to meet changes in the users' requirements. The individual blank cut-outs within a given set of cut-outs can be customized with specific connections to meet the users' needs at the site of installation. Additionally, the connections may be changed and/or upgraded over time to meet with changes in a users' requirements.

Figure 8A:
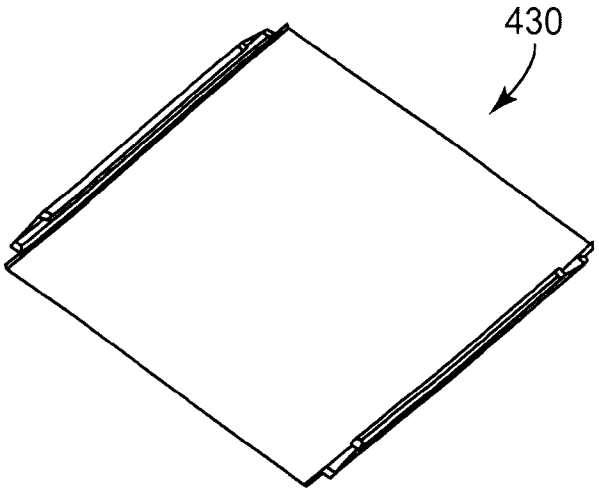
FIG. 8A is a perspective view of a sliding access panel provided in accordance with an embodiment of the present invention.
Figure 8B:
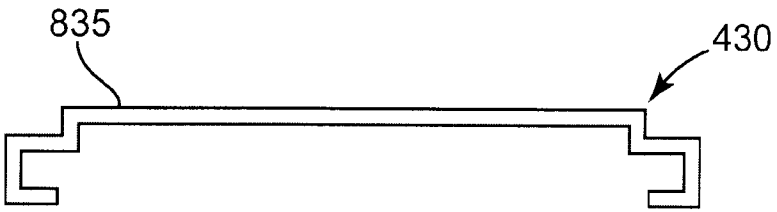
FIG. 8B is an end cross-sectional view of the sliding access panel shown in FIG. 8A provided in accordance with an embodiment of the present invention.

FIG. 8A is a perspective view and FIG. 8B is a side view of a sliding access panel 430, as introduced in FIGS. 4A and 4B. According to various embodiments of the present invention, the sliding access panel 430 is adapted to be disposed between a bezel portion 420 and a trough portion 425, as described above. Each sliding access panel 430 is sized such that it adequately covers the openings 550 formed in the top plate 540 of the trough portion 425 such that the utility modules 655 can be concealed when the sliding access panel is in a closed position. Additionally, each sliding access panel 430 is sufficiently sized such that they are adapted to slide in a space defined between the bezel portion 420 and the trough portion 425. According to some embodiments, the sliding access panels are adapted to slide between at least a first position in which the utility modules including any utility connections are fully concealed and a second position in which the utility modules are at least partially exposed. In some embodiments an exposed surface 835 of each sliding access panel 430 is smooth. According to other embodiments, the exposed surface 835 can include at least one finger groove such that a user can locate and actuate the sliding access panel between various positions. Each sliding access panel 430 is adapted to slide independently of the other.

Figure 9A:
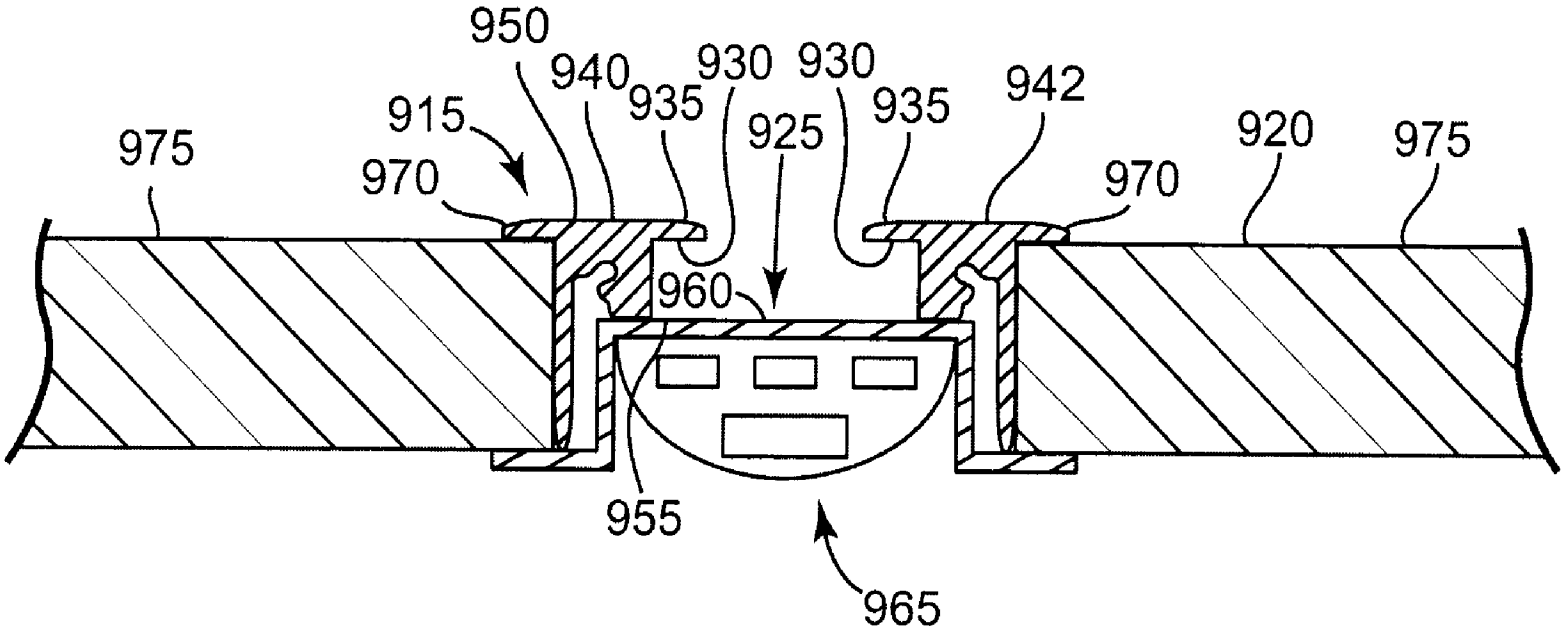
FIG. 9A is an end cross-sectional view of a worksurface including a technology trough assembly provided in accordance with an embodiment of the present invention.

FIG. 9A is a cross-sectional view of a technology trough assembly 915 integrated into a worksurface 920. As shown in FIG. 9A a space 925 is defined between a lower surface 930 of the inner lips 935 of the side members 940, 942 defining the bezel portion 950 and an upper surface 955 of the top plate 960 of the trough portion 965. The outer lips 970 of the side members 940, 942 rest on an upper surface 975 of the worksurface 920.

Figure 9B:
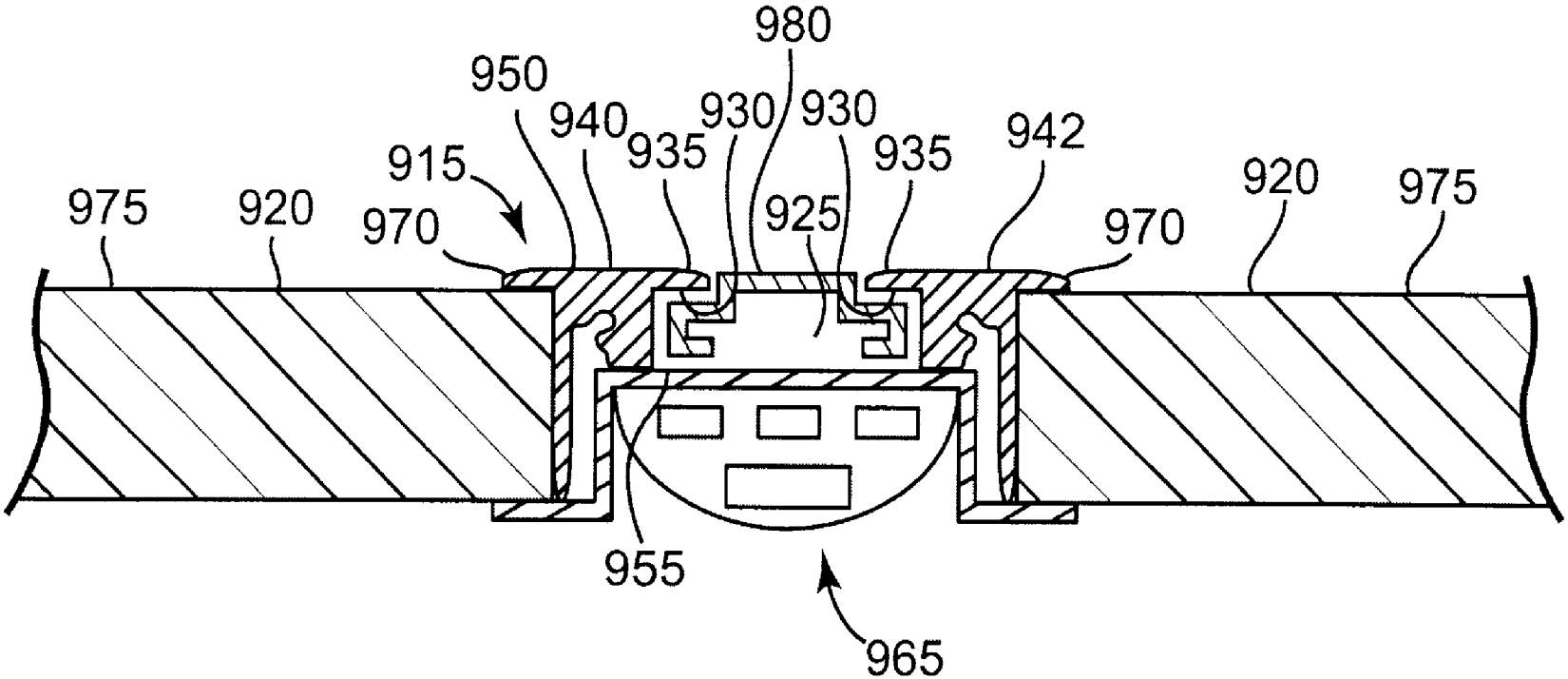
FIG. 9B is an end cross-sectional view of a worksurface including a technology trough assembly, as shown in FIG. 9A, including a sliding access panel provided in accordance with an embodiment of the present invention.

As shown in FIG. 9B, the technology trough assembly 915 includes a sliding access panel 980 is disposed in the space 925 defined between the bezel portion 950 and the trough portion 965. The height of the space 925 is such that it is able to accommodate the height of the sliding access panel(s) 980. According to one embodiment, the height of the space 925 formed between the bezel portion 950 and the trough portion 965 ranges from about 0.3 inches to about 0.5 inches. Additionally, a length and width of the space is such that it is sufficiently able to accommodate a length and width of the sliding access panel in either an open, closed, or an intermediate position. The space 925 between the bezel portion 950 and the trough portion 965 facilitates the sliding access panel (s) 980 to easily slide from a closed portion in which the utility modules and utility connections are fully concealed beneath the sliding access panel 980 to an open position in which the utility modules and connections are fully exposed and intermediate positions there between. The space 925 is also of sufficient height such that it is able to accommodate a number of wires or cables for forming utility connections to equipment on the furniture assembly or conference table when the sliding access panels 980 are fully closed.

Figure 10A:
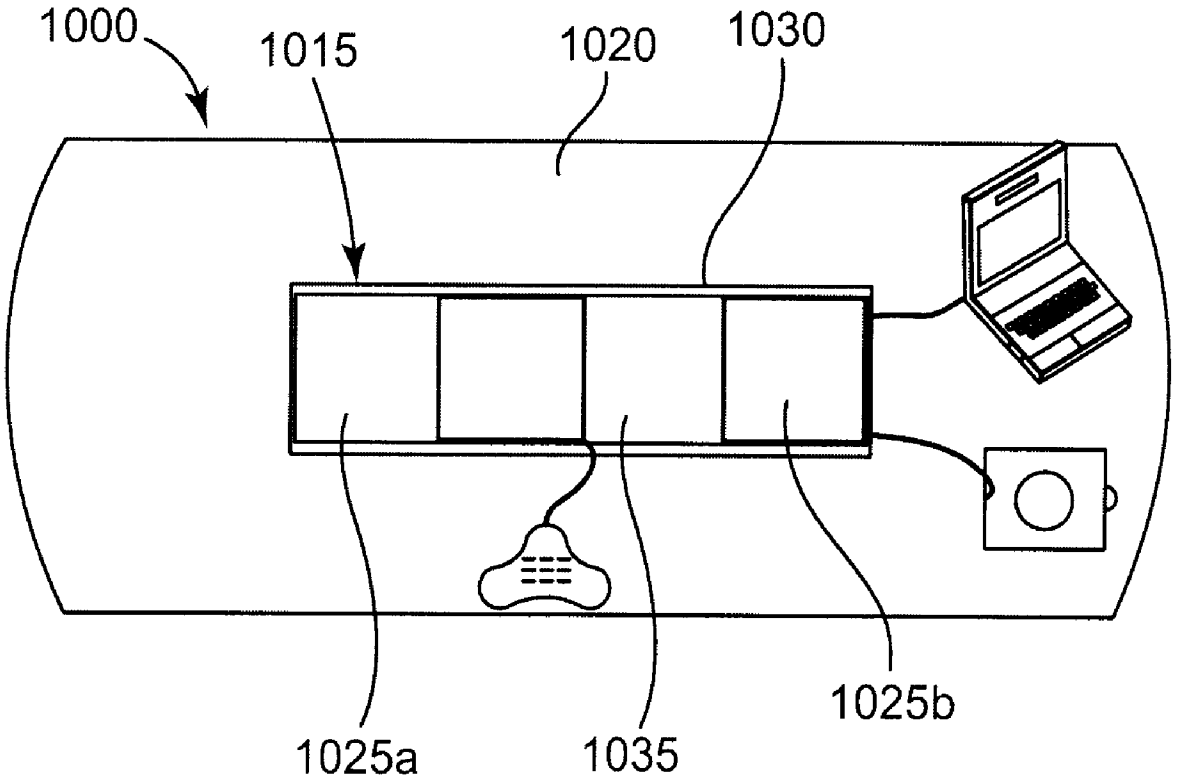
FIGS. 10A-10C are top plan views of a table including a technology trough assembly provided in accordance with various embodiments of the present invention.
Figure 10B:
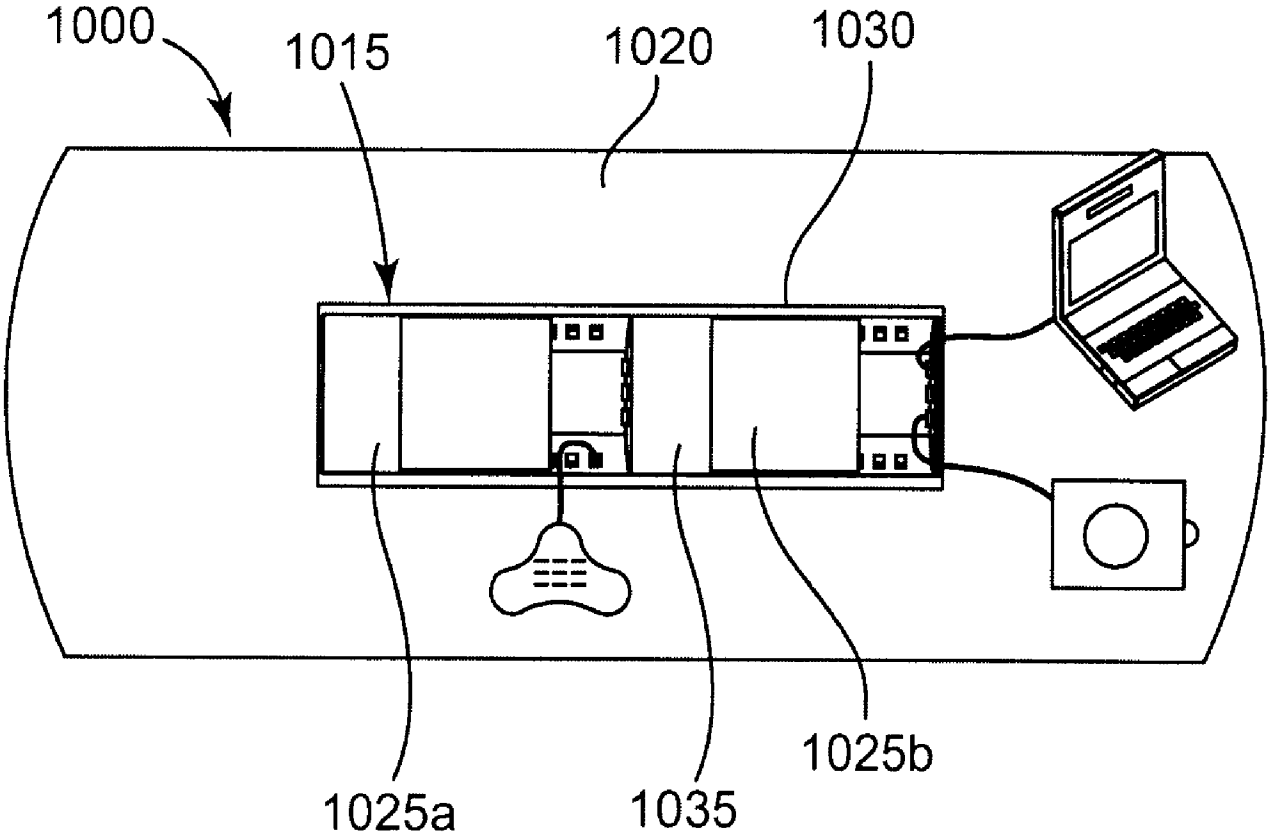
Figure 10C:
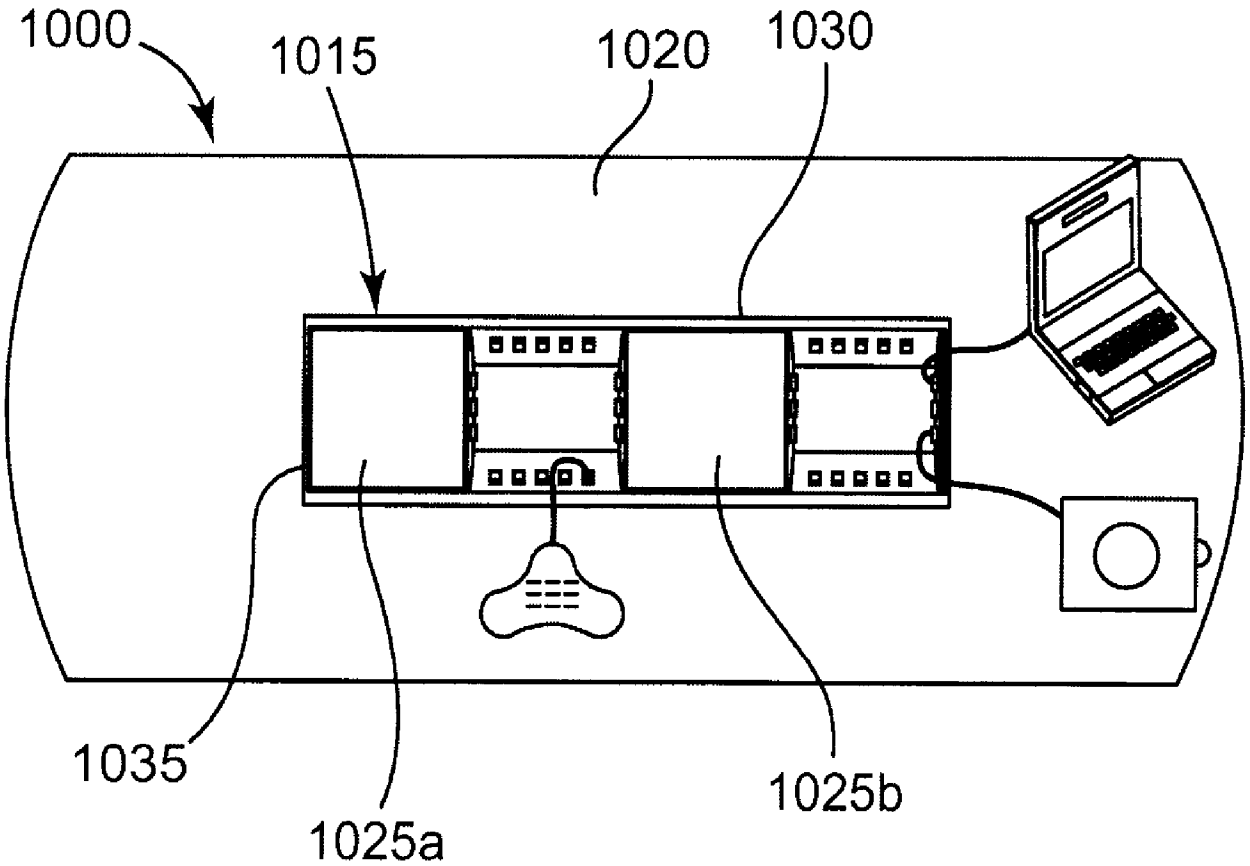

FIGS. 10A-10C are top plan views of a table 1000 including a technology trough assembly 1015 integrated into its worksurface 1020 according to the various embodiments described above. The technology trough assembly 1015 is integrated into the worksurface of an article of furniture such that it is accessible through the opening in the worksurface 1020. As shown in FIGS. 10A-10C, the technology trough assembly 1015 includes two sliding access panels 1025*a* and 1025*b*. The sliding access panels 1025*a* and 1025*b* are disposed between the bezel 1030 and the trough portion 1035. The technology trough assembly 1015 is integrated within the worksurface 1020 such that it does not substantially protrude above an upper surface of the worksurface 1020. According to another embodiment, the technology trough assembly 1015 is integrated within the worksurface 1020 such that the assembly 1015 including the sliding access panels 1025*a* and 1025*b* are substantially flush with the top surface of the worksurface 1020 when the sliding access panels 1025*a* and/or 1025*b* are in an open or a closed position.

In a closed position, the utility connections located within the technology trough assembly 1015 are concealed by the sliding access doors 1025*a*, 1025*b* disposed between the bezel portion 1030 and the trough portion 1035. When the sliding access doors 1025*a* and/or 1025*b* are in an intermediate position, the utility connections are partially exposed. When the sliding access panels 1025*a* and/or 1025*b* are in an open position, they do not protrude above the top surface of the worksurface 1020 and the utility connections contained within the trough portion are fully exposed. The sliding access doors 1025*a* and 1025*b* remain flush with the worksurface 1020 when in an open, closed position, or intermediate position so as not to create visual or physical obstructions between users seated at the conference table 1000.

Figure 11:
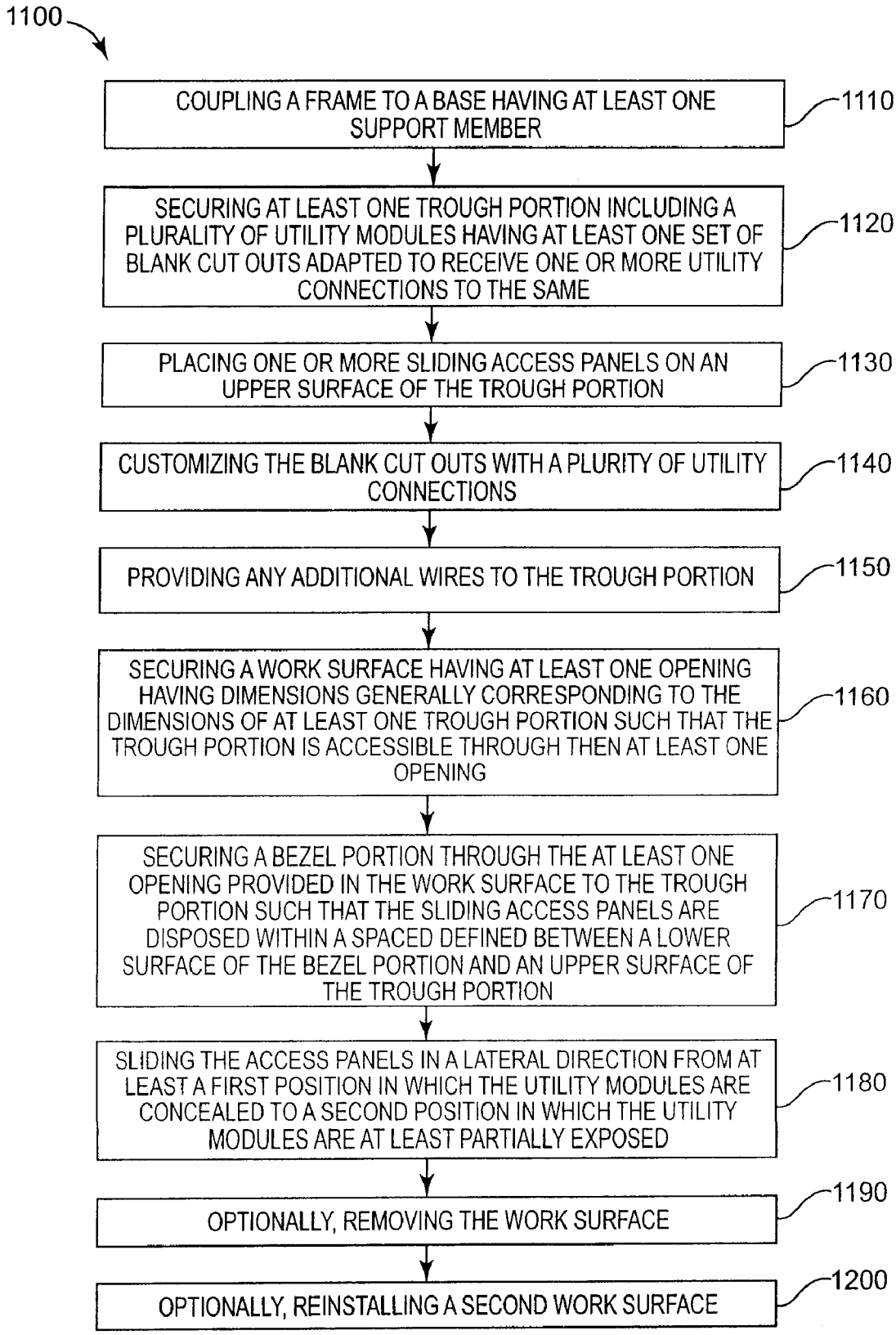
FIG. 11 is a flow chart of a method of assembling an article of furniture in accordance with the present invention.

FIG. 11 is a flow chart of a method 1100 of assembling an article of furniture according to an embodiment of the present invention. As shown in FIG. 11, a frame is coupled to a base including at least one support member (Block 1110). Next, at least one trough portion is secured to the frame (Block 1120). The trough portion includes a plurality of utility modules each having at least one set of blank cut-outs adapted to receive one or more utility connections. According to some embodiments, at least one of the cut-outs can be adapted to receive an Extron single or double architectural adapter plate. One or more sliding access panels are placed on an upper surface of the trough portion (Block 1130). After the trough portion has been secured to the frame, the blank cut-outs located in the utility modules are customized with a plurality of data and/or power connections and any additional wiring is provided (Blocks 1140 and 1150). Next, a first worksurface including one or more openings having dimensions generally corresponding to the dimensions of the at least one trough portion is coupled to the frame such that the trough portion is accessible through the openings (Block 1160). Finally, the bezel portion is installed through the at least one opening located in the worksurface such that the sliding access panels are encapsulated in a space defined between a lower surface of the bezel portion and the upper surface of the trough portion (Block 1170). The sliding access panels are operated in a lateral direction by a user between at least a first position in which the utility modules are concealed and a second position in which the utility modules are at least partially exposed (Block 1180). In the second position the sliding access panels do not protrude above the upper surface of the worksurface.

According to other embodiments of the present invention, the method of assembling an article of furniture can include removing the bezel portion followed by the worksurface and installing a second worksurface (Blocks 1190 and 1200). The second worksurface can be of a different size, shape, or finish than the prior worksurface.

The installation of the technology trough assembly prior to the installation of the worksurface allows the utility connections to be integrated and managed before the worksurface is installed. This facilitates installation of the utility connections as well as prevents damage to the worksurface from occurring during such installation. Additionally, a method of assembling an article of furniture in which the worksurface is added after the technology trough assembly has been provided and the utility connections installed, allows the first work surface to be easily exchanged with a different or newer worksurface to meet changes in the users' needs or requirements.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A furniture assembly comprising:

a planar worksurface supported on a base including an opening; and at least one technology trough assembly having a trough portion that is accessible through the opening in the planar worksurface and an upper, exposed surface adjacent the trough portion and the planar worksurface, the upper, exposed planar surface exposed through the opening in the planar worksurface, the trough portion comprising at least one side wall including a plurality of utility connections and a sliding access panel adapted to slide in a lateral direction along a longitudinal axis of the worksurface from at least a first position to a second position so that the plurality of utility connections are accessible from either side of the planar worksurface, wherein in first position the utility connections are concealed by the sliding access panel and the upper, exposed surface adjacent the trough portion is exposed through the opening and wherein in the second position the upper surface adjacent the trough portion is at least partially concealed by the sliding access panel and the utility connections are at least partially exposed through the opening.

2. The furniture assembly according to claim 1, wherein the furniture assembly is a conference table.

3. The furniture assembly according to claim 1, wherein the sliding access panel does not protrude above the planar worksurface in either the first position or the second position.

4. The furniture assembly according to claim 1, wherein the sliding access panel is adapted to slide to a third position in which the utility connections are fully exposed.

5. The furniture assembly according to claim 4, wherein when in the third position, the sliding access panel does not protrude above the planar worksurface.

6. The furniture assembly according to claim 1, wherein the technology trough assembly further comprises a bezel portion coupled to the trough portion such that a space is defined between the bezel portion and the trough portion, wherein the sliding access panel is disposed in the space.

7. The furniture assembly according to claim 6, wherein the space is of sufficient height to allow a cable or a wire to be connected to at least one of the utility connections when the sliding access panel is in the first position.

8. The furniture assembly according to claim 1, wherein the technology trough assembly is secured to a frame including one or more wire management features coupled to the base.

9. The furniture assembly according to claim 1, wherein the base includes at least one support member.

10. A conference table comprising:

a planar worksurface supported on base; and at least one technology trough assembly integrated into the planar worksurface such that it does not substantially protrude above a top surface of the planar worksurface, the technology trough assembly comprising a trough portion and an upper surface adjacent the trough portion and accessible by a user, the trough portion comprising at least one side wall including a plurality of utility connections and a sliding access panel adapted to slide in a lateral direction along a longitudinal axis of the worksurface between a closed position and an open position so that the plurality of utility connections are accessible from either side of the planar worksurface, wherein when the sliding access panel is in the closed position the utility connections are concealed by the sliding access panel and the upper surface adjacent the trough portion is exposed for access by a user and wherein in the open position the upper surface adjacent the trough portion is at least partially concealed by the sliding access panel and the utility connections are at least partially exposed for access by a user, and wherein in the open position the sliding access panels do not protrude above the top surface of the planar worksurface.

11. The conference table according to claim 10, wherein the sliding access panel is adapted to slide to a third position in which the utility connections are fully exposed.

12. The conference table according to claim 10, wherein the technology trough assembly further comprises a bezel portion coupled to the trough portion such that a space is defined between the bezel portion and the trough portion wherein the sliding access panel is disposed in the space.

13. The conference table according to claim 10, wherein the space is of a sufficient height to allow a cable or a wire to be connected to at least one of the utility connections when the sliding access panel is in the closed position.

14. A furniture assembly comprising:

a base including at least one support member;

a frame mounted to the base, the frame including one or more wire management features adapted to manage and conceal one or more wires or cables;

a trough portion coupled to the frame, the trough portion including a top plate having a lower surface, an upper surface and a plurality of openings, a plurality of utility modules having a generally U-shaped portion defining a recess and two side walls and at least one set of blank cut-outs including at least one cut-out adapted to receive a utility connection, the plurality of utility modules coupled to the lower surface of the top plate such that the recesses defined by the generally U-shaped portion correspond to the openings in the top plate;

a worksurface mounted to the frame, the worksurface including an opening having dimensions generally corresponding to outer dimensions of the trough portion, wherein the worksurface is mounted to the frame such that the trough portion is accessible through the opening;

a bezel portion coupled to the trough portion through the opening in the worksurface such that a space is defined between a lower surface of the bezel portion and the upper surface of the top plate of the trough portion; and a plurality of sliding access panels disposed in the space defined between the lower surface of the bezel portion and the upper surface of the top plate of the trough portion, the sliding access panels having dimensions generally corresponding to dimensions of the openings in the top plate of the trough portion, the sliding access panels adapted to laterally slide from at least a first position wherein the recesses defined by the generally U-shaped portion coupled to the top plate are concealed to a second position, wherein the recesses defined by the generally U-shaped portion are exposed.

15. A technology trough assembly comprising:

a trough portion including a top plate having a lower surface, an upper surface and a plurality of openings, a plurality of utility modules having a generally U-shaped portion defining a recess and two side walls, the plurality of utility modules coupled to the lower surface of the top plate such that the recesses defined by the generally U-shaped portion correspond to the openings in the top plate;

a bezel portion coupled to the top plate of the trough portion, wherein a space is defined between a lower surface of the bezel portion and an upper surface of the top plate of the trough portion; and a plurality of sliding access panels disposed in the space defined between the lower surface of the bezel portion and the upper surface of the top plate of the trough portion, the sliding access panels having dimensions generally corresponding to dimensions of the openings in the top plate of the trough portion, the sliding access panels adapted to freely slide along a horizontal plane from at least a first position wherein the recesses defined by the generally U-shaped portion coupled to the top plate are concealed to a second position, wherein the recesses defined by the generally U-shaped portion are exposed and wherein in the second position, the sliding access panels do not extend upward from the horizontal plane in which they slide.

16. The technology trough assembly according to claim 15, wherein the utility modules each include at least one set of blank cut-outs including at least one cut-out adapted to receive a utility connection.

17. The technology trough assembly according to claim 16, wherein the utility modules each include at least one utility connection installed within the at least one cut-out configured to receive a utility connection.

18. The technology trough assembly according to claim 16, wherein the utility connection can be a power, data, audio, visual, telecommunication, or a control connection.

19. A method of assembling an article of furniture comprising:

coupling a frame to a base having at least one support member;

securing at least one trough assembly to the frame, the trough assembly including a trough portion and an upper surface adjacent the trough portion, the trough portion having at least one side wall including at least one set of blank cut-outs adapted to receive one or more utility connections;

installing one or more utility connections in the trough portion;

securing a worksurface including at least one opening to the frame such that the trough portion and the upper surface adjacent the trough portion are accessible through the opening; and placing a sliding access panel on the upper surface adjacent the trough portion such that the sliding access panel is adapted to slide in a lateral direction along a longitudinal axis of the worksurface from a first position to a second position, wherein in the first position the utility connections are concealed by the sliding access panel and the upper surface adjacent the trough portion is exposed for access by a user and wherein in the second position the upper surface adjacent the trough portion is at least partially concealed by the sliding access panel and the utility connections are at least partially exposed for access by a user.

20. The method according to claim 19, further comprising securing a bezel portion through the opening in the worksurface to the trough portion such that the sliding access panel is disposed in a space defined between a lower surface of the bezel portion and the upper surface of the trough portion.

21. The method according to claim 19, further comprising sliding the sliding access panel in a lateral direction over the trough portion between the first position and the second position.

* * * * *